United States Patent [19]

Plasko

[11] Patent Number: 4,821,010

[45] Date of Patent: Apr. 11, 1989

[54] THERMAL CUTOFF HEATER

[75] Inventor: Emil R. Plasko, Lexington, Ohio

[73] Assignee: Therm-O-Disc, Incorporated, Mansfield, Ohio

[21] Appl. No.: 139,324

[22] Filed: Dec. 30, 1987

[51] Int. Cl.[4] ..... H01H 37/76; H01H 85/00

[52] U.S. Cl. ..... 337/405; 337/4; 337/183; 337/407

[58] Field of Search ..... 337/401–409, 337/102–107, 182, 183, 184; 338/22 R, 23; 219/511, 517, 535, 549

[56] References Cited

U.S. PATENT DOCUMENTS

| | | | |
|---|---|---|---|
| 3,621,446 | 11/1971 | Smith | 338/23 |
| 3,717,793 | 2/1973 | Peterson | 219/517 |
| 3,794,950 | 2/1974 | Kilner | 338/23 |
| 4,174,511 | 11/1979 | Knapp | 219/511 |
| 4,641,120 | 2/1987 | Bonfig | 337/242 |

*Primary Examiner*—H. Broome

*Attorney, Agent, or Firm*—Jones, Day, Reavis & Pogue

[57] ABSTRACT

A thermal cutoff includes a housing having a resistive coating bonded thereto, and defining a heater for heating the thermal cutoff to its firing temperature.

14 Claims, 3 Drawing Sheets

THERMAL CUTOFF HEATER

BACKGROUND OF THE INVENTION

This application relates to the art of thermal cutoffs and, more particularly, to thermal cutoffs for protecting electric circuits. The invention is particularly applicable for use with thermal cutoffs of the type having a meltable thermal pellet, and will be described with specific reference thereto. However, it will be appreciated that the invention has broader aspects, and can be used with other types of thermal cutoffs.

Resistor wire or etched foil elements have been positioned in surrounding relationship to thermal cutoffs for heating same to the firing temperature. These arrangements are relatively expensive, and it is also difficult to control the heating rate. It would be desirable to have a low cost arrangement for providing a thermal cutoff with an external heater whose heating rate can be controlled.

SUMMARY OF THE INVENTION

A thermal cutoff includes a housing having a resistive coating bonded thereto for providing a heater for the thermal cutoff.

The housing may be electrically conductive, and a dielectric coating may be interposed between the housing and resistive coating.

Highly conductive contacts are bonded to the resistive coating for connecting same in an electric circuit. The heating rate of the heater defined by the resistive coating can be adjusted to a desired value during manufacture as by varying the distance between the highly conductive contacts, or by changing the composition or geometry of the conductive coating.

Connecting means is provided for connecting the thermal cutoff and the resistive coating in an electric circuit. In one arrangement, the connecting means includes one common connection for both the thermal cutoff and the resistive coating. In another arrangement, the connecting means is completely independent for both the thermal cutoff and the resistive coating.

In one arrangement that includes an electrically conductive housing, one end portion of the housing is uncoated with the dielectric coating. The resistive coating is conductively bonded to the housing one end portion, and extends over the dielectric coating toward the other end portion of the housing. A highly conductive contact is bonded to the resistive coating at a location spaced toward the other housing end portion from the one housing end portion.

The housing for the thermal cutoff can be of dielectric material, in which case the dielectric coating may be omitted and the resistive coating bonded directly to the housing.

The resistive coating can be a continuous coating that completely covers the dielectric coating. However, it is also possible to arrange the resistive coating in various geometric patterns such that the coating is physically discontinuous, while providing a continuous electrically conductive path. Examples include a spiral stripe, linear or skewed strips, and coatings with holes therein.

It is a principal object of the present invention to provide an improved arrangement for heating a thermal cutoff.

It is also an object of the invention to provide a heated thermal cutoff that is economical to manufacture and assemble.

It is a further object of the invention to provide a thermal cutoff with a resistance heater whose heating rate can be controlled.

It is an additional object of the invention to provide a thermal cutoff and a resistance heater therefor with a common connection for connecting same in an electric circuit.

DESCRIPTION OF PREFERRED EMBODIMENTS

Figure 1:
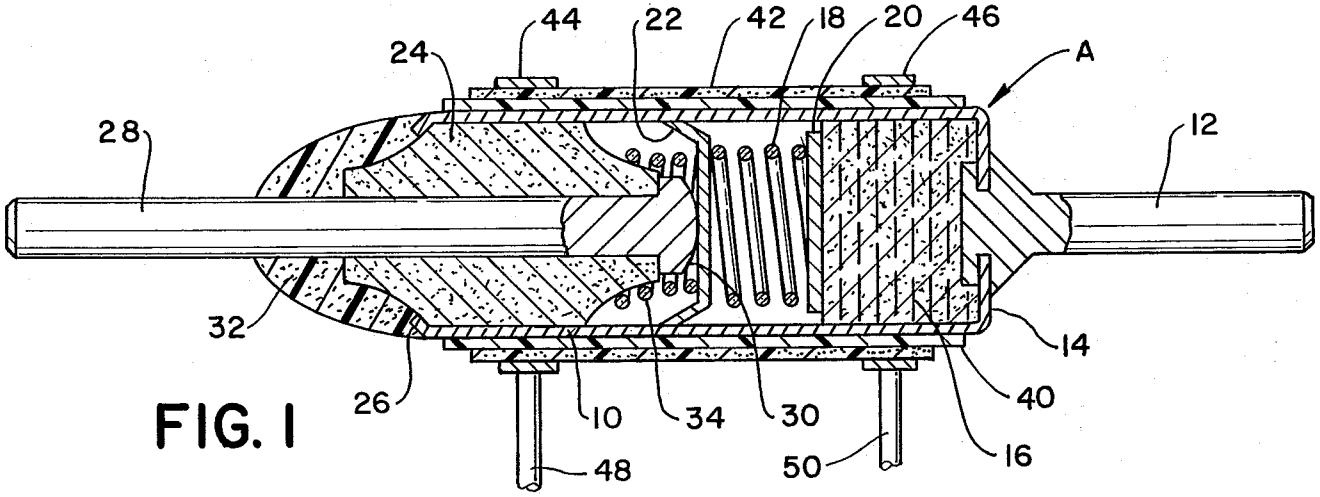
FIG. 1 is a cross-sectional elevational view of a thermal cutoff having the improved heater of the present application attached thereto.

Referring now to the drawing, wherein the showings are for purposes of illustrating certain preferred embodiments of the invention only, and not for purposes of limiting same, FIG. 1 shows a thermal cutoff A constructed in accordance with the present application. A generally cup-shaped conductive metal housing 10 has a lead 12 attached to one end 14 thereof. Thermal means in the form of a meltable thermal pellet 16 is received in housing 10 adjacent end 14. Thermal pellet 16 may be an organic chemical, such as caffeine or animal protein. A coil spring 18 is compressed between a disc 20 and a slidable star contact 22. Star contact 22 has a plurality of circumferentially-spaced outwardly inclined resilient fingers that resiliently engage the interior of housing 10 in sliding conductive relationship therewith. A ceramic bushing 24 is retained within housing 10 by deforming end portion 26 inwardly. A lead 28 mounted in bushing 24 has a contact 30 thereon. Bushing 24 and lead 28 are covered by epoxy sealant 32. A coil spring 34 is compressed between bushing 24 and star contact 22 around lead contact 30.

In the position of FIG. 1, there is a conductive path from lead 12 to lead 28 through housing A to star contact 22, and then to lead contact 30. When thermal pellet 16 reaches its predetermined firing or melting temperature, coil spring 18 expands when pellet 16 becomes liquid, and the biasing force of spring 34 becomes greater than the biasing force of spring 18. This moves star contact 22 to the right in FIG. 1 away from lead contact 30 so there is no longer a conductive path from lead 12 to lead 28.

A dielectric coating 40 is bonded to the exterior of housing 10. Dielectric coating 40 may be a dielectric paint, plastic material or rubber. Dielectric coating 40 can be of a material that is bondable to housing 10 at ambient temperature, or can be one that is baked thereon at an elevated temperature. By way of example only, and not by way of limitation, the dielectric coating may be an epoxy.

An electrically conductive resistive coating 42 is bonded to dielectric coating 40. Resistive coating 42 can be a resistive paint or a resistive plastic material. For example, paints or plastic materials filled with powder or particles of resistive materials can be used. By way of example only, and not by way of limitation, the resistive coating may be a blend of phenolic and epoxy filled with particles of carbon that may be in the form of graphite.

Spaced-apart contacts 44, 46 of highly conductive material are bonded to resistive coating 42. Contacts 44, 46 are circumferential bands, and can be of an epoxy or other adhesive filled with highly conductive particles of silver or the like. Obviously, highly conductive contacts 44, 46 can be of other highly conductive paint or plastic materials. Contacts 44, 46 are spaced-apart longitudinally of housing 10, and varying such spacing makes it possible to vary the resistance and heating rate of the heater defined by resistive coating 42. Suitable leads 48, 50 can be connected with contacts 44, 46 as by the use of conductive adhesive or the like.

Figure 2:
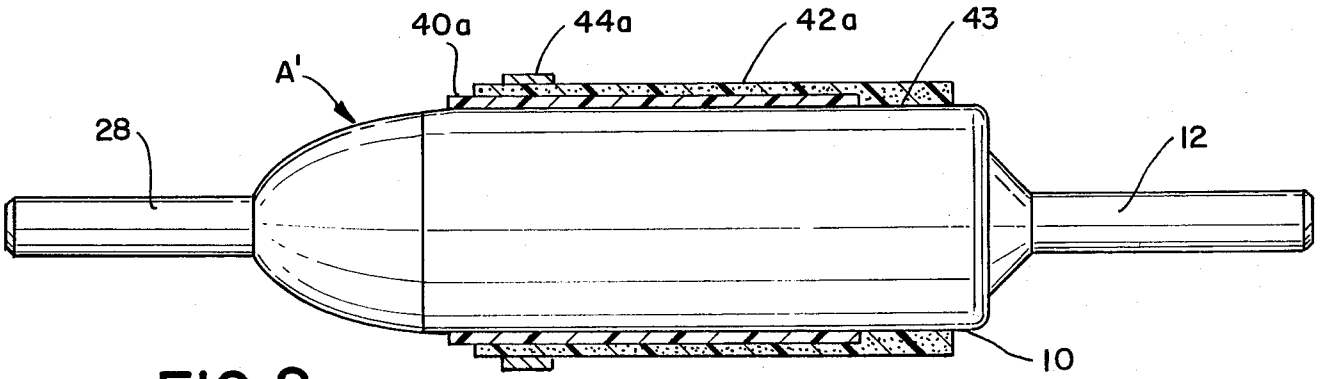
FIG. 2 is a partial cross-sectional elevational view of another arrangement.

FIG. 2 shows dielectric coating 40*a* extending along only a portion of housing 10 to leave one housing end portion 43 uncoated with dielectric material. Resistive coating 42*a* is bonded in conductive relationship with the one end portion 43 of housing 10, and extends therefrom over dielectric coating 40*a* toward the other end of housing 10. A highly conductive contact 44*a* is bonded to resistive coating 42 at a location spaced toward the other end of housing 10 from housing one end portion 43.

In the arrangement of FIG. 1, leads 12, 28, 48 and 50 provide connecting means for connecting the thermal cutoff and the resistance heater in an electric circuit. In the arrangement of FIG. 1, the thermal cutoff and the resistance heater are independently connected in an electric circuit. In the arrangement of FIG. 2, leads 12, 28 and contact 44*a* define connecting means for connecting the thermal cutoff and the resistance heater in an electric circuit. In the arrangement of FIG. 2, the thermal cutoff and the resistance heater have one common connection defined by lead 12.

Figure 3:
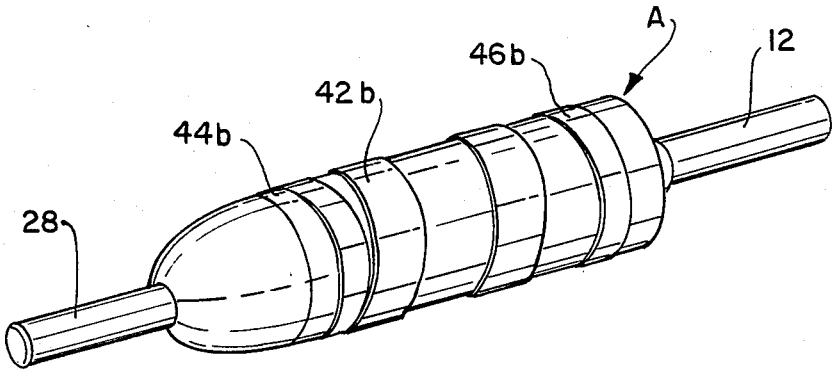
FIG. 3 is a perspective illustration of another arrangement.

FIG. 3 shows a thermal cutoff having the resistive coating 42*b* applied over the dielectric coating in the form of a spiral stripe. Highly conductive contacts 44*b*, 46*b* are conductively bonded adjacent the opposite end portions of the spiral stripe.

It will be recognized that the resistive coating can take other geometric forms and shapes. For example, and not by way of limitation, linear or skewed resistive strips can extend along the housing between the highly conductive contacts. Holes of various sizes and shapes can be provided in the resistive coating. Also, the composition and thickness of the resistive coating can be varied.

The improvements of the present application can also be used with thermal cutoffs of the type having a housing of dielectric material. In such arrangements, the resistive coating can be applied directly to the housing without first providing a separate coating of dielectric material. For example, the housing can be of glass, and the thermal pellet can be of electrically conductive metal having a relatively low melting temperature. The conductive path is then internal of the housing, except for the external leads, and such path includes the meltable pellet.

The resistive coating of the present application provides a permanently affixed heater that is tenaciously bonded to the thermal cutoff housing, either with or without a separating insulating layer of dielectric material. The resistive coating is applied in a liquid or fluent state, and is cured in-situ on the thermal cutoff.

Where the resistive coating is a spiral stripe, linear or skewed strips, or has holes therein, such coating is physically discontinuous between its opposite end portions, while providing a continuous electrically conductive path between such end portions. The preferred resistive coating material used in the arrangements of the present application comprises a substantially homogeneous mixture or composition of conductive and non-conductive materials.

Figure 4:
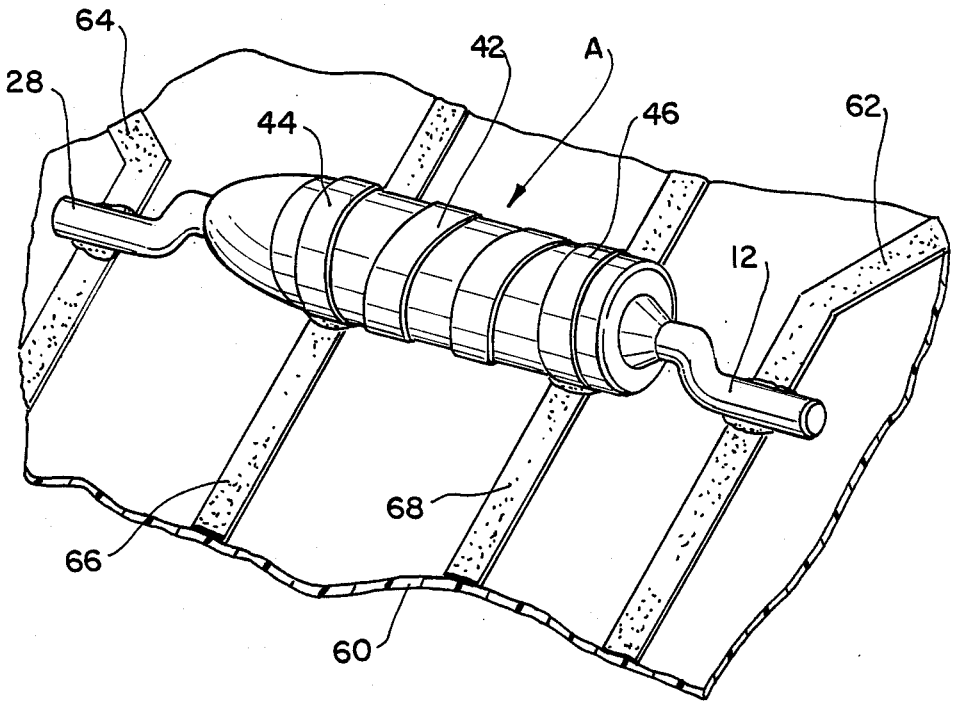
FIG. 4 is a perspective illustration showing the thermal cutoff connected in an electric circuit with connective adhesive.

FIG. 4 shows a section of a circuit board 60 or the like having conductive adhesive strips 62, 64 to which thermal cutoff leads 12, 28 are bonded. Conductive adhesive strips 66, 68 are bonded to contacts 44, 46. The adhesive strips are suitably connected to the other portions of the circuit.

Figure 5:
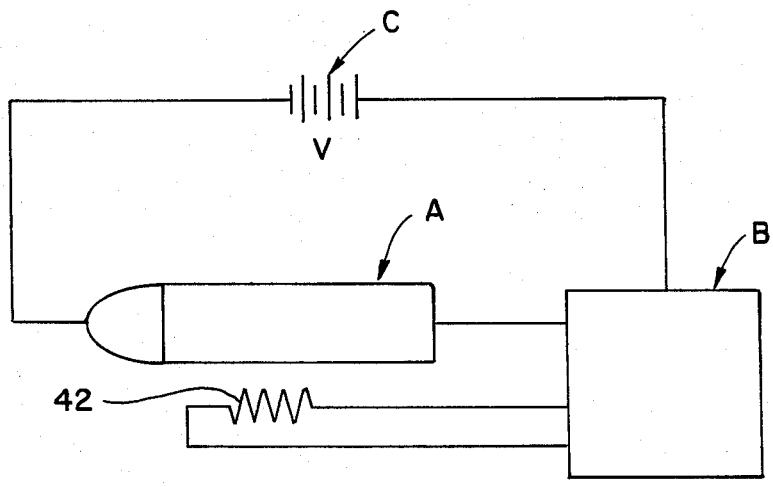
FIG. 5 is a schematic circuit showing how the thermal cutoff of FIG. 1 can be connected in an electric circuit.

FIG. 5 shows thermal cutoff A connected in series with a load B and a voltage source C. The resistance heater defined by resistive coating 42 is connected with load B such that a short in load B will cause a small current to flow through resistance heater 42. This raises the temperature of the thermal cutoff to the melting temperature of the thermal means defined by the meltable pellet. When the resistance heater circuit is energized, the device acts as a current sensitive fuse. However, the device can also act as a thermally sensitive fuse without energization of the resistance heater circuit. For example, in the event of a malfunction that causes the load to give off excessive heat, the thermal pellet will melt and open the circuit without receiving any heat from the resistance heater circuit.

Figure 6:
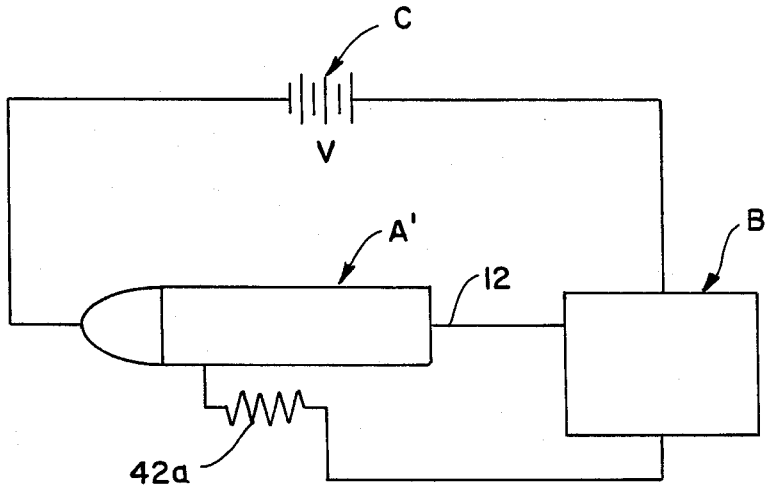
FIG. 6 is a schematic diagram showing how the thermal cutoff of FIG. 2 can be connected in an electric circuit.

FIG. 6 shows the thermal cutoff A′ of FIG. 2 connected in series with load B and voltage source C. The resistance heater defined by resistive coating 42 is connected with load B such that a short in load B causes a small current to flow through the resistance heater circuit to melt the thermal pellet. In the arrangement of FIG. 6, lead 12 provides a common connection for both the resistance heater and the thermal cutoff.

Although the invention has been shown and described with respect to certain preferred embodiments, it is obvious that equivalent alterations and modifications will occur to others skilled in the art upon the reading and understanding of this specification. The present invention includes all such equivalent alterations and modifications, and is limited only by the scope of the claims.

I claim:

1. A thermal cutoff including a hollow electrically conductive housing containing thermal means responsive to a predetermined temperature for interrupting current flow through said housing, and an electrically conductive resistive coating bonded to said housing for transferring heat to said thermal means to raise the temperature of said thermal means.

2. The cutoff of claim 1 including a dielectric coating covering at least part of said housing and being interposed between said housing and said resistive coating, said dielectric coating being bonded to said housing and said resistive coating being bonded to said dielectric coating.

3. The cutoff of claim 2 wherein said housing has opposite end portions and one of said end portions is uncoated by said dielectric coating, said resistive coating being bonded to said one end portion of said housing in conductive relationship, and said resistive coating extending from said housing one end portion over said dielectric coating toward the other end portion of said housing.

4. The cutoff of claim 3 including a high conductivity contact bonded to said resistive coating in a location spaced from said housing one end portion toward said housing other end portion.

5. The cutoff of claim 4 wherein said contact comprises a high conductivity coating bonded to said resistive coating.

6. The cutoff of claim 1 wherein said resistive coating is a composition including both conductive and non-conductive materials.

7. The cutoff of claim 1 wherein said resistive coating is applied to said housing in a fluent state and is solidified in-situ thereon.

8. The cutoff of claim 1 including a pair of high conductivity contacts bonded to said resistive coating and being spaced-apart longitudinally of said housing.

9. The cutoff of claim 1 wherein said resistive coating has opposite end portions and is continuous between said end portions.

10. The cutoff of claim 1 wherein said resistive coating has opposite end portions and covers substantially less than the entire area of said housing between said end portions of said resistive coating while providing a continuous electrically conductive path between said end portions of said resistive coating.

11. An electrically conductive thermal cutoff including a housing containing thermal means responsive to a predetermined temperature for interrupting current flow, a resistive coating bonded to the exterior of said housing, and connecting means for connecting said thermal means and said resistive coating in an electric circuit, said connecting means including a common connection for said thermal means and said resistive coating.

12. The cutoff of claim 11 including a dielectric coating interposed between said housing and at least a portion of said resistive coating.

13. A thermal cutoff including a generally cylindrical electrically conductive housing containing thermal means responsive to a predetermined temperature for interrupting current flow, a dielectric coating bonded to said housing, a resistive coating bonded to said dielectric coating, and contact means bonded to said resistive coating for connecting same in an electric circuit.

14. The cutoff of claim 13 wherein said contact means comprises a single contact bonded to said resistive coating, and a portion of said resistive coating spaced from said contact is conductively bonded to said housing.

* * * * *